United States Patent [19]

Moore, Jr. et al.

[11] Patent Number: 4,890,421

[45] Date of Patent: Jan. 2, 1990

[54] AUTOMATIC MEASUREMENT SYSTEM

[75] Inventors: Wayne R. Moore, Jr., Trumbull; Kevin S. Barney, Monroe, both of Conn.

[73] Assignee: Moore Special Tool Co., Inc., Bridgeport, Conn.

[21] Appl. No.: 98,078

[22] Filed: Sep. 21, 1987

[51] Int. Cl.[4] ..... B24B 49/00

[52] U.S. Cl. ..... 51/165 R; 33/644; 33/645; 33/642; 33/626; 33/550; 408/61

[58] Field of Search ..... 51/165 R, 165.74, 165.75; 408/8, 13, 75, 61; 33/644, 645, 642, 626, 169 D, 169 C, 172 D, 550

[56] References Cited

U.S. PATENT DOCUMENTS

| | | | |
|---|---|---|---|
| 3,624,971 | 12/1971 | Levi | 51/165.74 |
| 4,128,945 | 12/1978 | Barritt | 33/181 R |
| 4,569,157 | 2/1986 | Riehle | 51/165.75 |

*Primary Examiner*—Frederick R. Schmidt
*Assistant Examiner*—Maurina Rachuba
*Attorney, Agent, or Firm*—Kramer, Brufsky & Cifelli

[57] ABSTRACT

The present invention relates to an automatic measurement system and the method of employing the system with a cutting tool device. The measurement system includes a tool holder for mounting a cutting tool. A measurement probe is automatically mounted and dismounted from the tool holder without removing the cutting tool. The tool holder is preferably affixed to a work support table which is adapted to support a workpiece to be machined and measured thereon.

21 Claims, 3 Drawing Sheets

AUTOMATIC MEASUREMENT SYSTEM

BACKGROUND AND SUMMARY OF THE INVENTION

While the invention is subject to a wide range of applications, it is especially suited for precise measurement of materials being machined. In particular, the present invention is directed to a measurement probe which can be automatically attached or removed from a grinding head without any disturbance of the cutting tool.

Manufacturers of precision machine tools employ a number of different techniques to automate the process of machining parts to size. One method is to measure the position of the cutting tool with respect to the part being machined using a probe or pickup as a reference. This method is satisfactory when the position detected by the pickup is the same position or can be correlated to the position that the tool actually cuts. Examples of this technique are illustrated in U.S. Pat. Nos. 4,365,301 and 4,428,055.

A second method for automatically machining parts is to first roughly cut the part to size with a cutting tool. Then, the cutting tool, carried by a machine, is exchanged with a measurement probe and the machine measures the machined part. The measurement probe is removed and replaced with the cutting tool for the final sizing of the part. This method is described in U.S. Pat. Nos. 4,118,871; 4,145,816; and 4,203,225. Although this technique can work well, it is difficult to return the cutting tool to exactly the same position in the cutting tool holder.

A third method is to permanently mount a measurement probe directly to the tool holder. However, the probe is subject to vibrations which could affect its reliability. This general concept is illustrated in U.S. Pat. Nos. 3,559,257 and 3,605,909.

Still another method of measuring a workpiece is to provide an inspection system which is supported by the work table. This approach can reduce the flexibility of the size and shape of parts being machined. Examples of this arrangement are illustrated in U.S. Pat. Nos. 3,774,312; 4,070,762; and 4,296,474

It is a problem underlying the present invention to provide an automatic measurement system which attaches the probe member to the cutting tool holder at the time of measurement and automatically removes the probe once the measurement has been completed.

It is an advantage of the present invention to provide an automatic measurement system which obviates one or more of the limitations and disadvantages of the described prior arrangements.

It is a further advantage of the present invention to provide an automatic measurement system which precisely determines the shape of the workpiece being measured.

It is yet a further advantage of the present invention to provide an automatic measuring system which is relatively uncomplicated and easily retrofitted onto machines which presently incorporate the prior art techniques of measuring the workpiece.

It is a still further advantage of the present invention to provide an automatic measurement system which is relatively inexpensive to manufacture.

Accordingly, there has been provided an automatic measuring system and method of using the system. This system is incorporated into a cutting tool machine which includes a tool holder for mounting a cutting tool. A measurement probe is provided and automatically mounted and dismounted from the tool holder.

DETAILED DESCRIPTION OF THE PREFERRED EMBODIMENT

Figure 1:
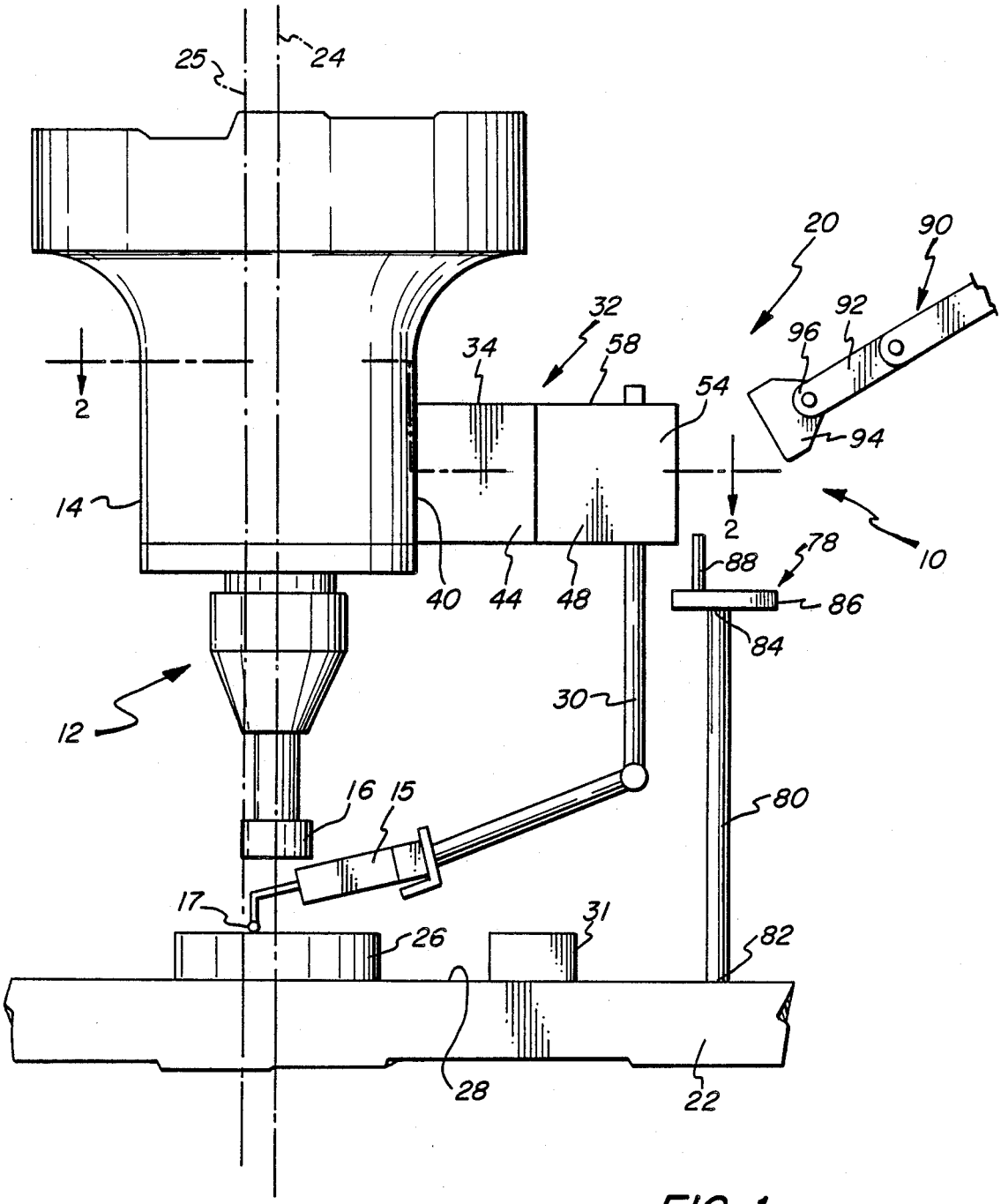
FIG. 1 is a schematic view of a jig grinder incorporating a measuring probe in accordance with the present invention.

The present invention relates to an automatic measurement system 10 adapted for use with a cutting tool device 12. A tool holder 14 is provided for mounting a cutting tool 16. Further, a measurement probe 15 and a device 20 for automatically mounting and dismounting the measurement probe 15 to and from said tool holder 14 is incorporated in the present invention.

Referring to FIG. 1, there is illustrated a cutting tool device 12 which is preferably a jig grinder of the type disclosed in U.S. Pat. Nos. 4,547,996 and 4,630,214. Although a jig grinder is incorporated in the preferred embodiment, it is within the terms of the present invention to incorporate any other desired cutting tool device, such as for example milling machines, grinding machines, lathes, and any other type of standard machine tool used in the manufacture of a wide variety of high precision products. The cutting tool device 12 includes a tool holder 14 which is stationary relative to the cutting tool 16. However, the tool holder 14, also known as the grinding head, is movable in a number of axes as described in U.S. Pat. Nos. 4,547,996 and 4,630,214. The cutting tool device 12 is affixed to a work support table 22 which is partially illustrated. The work support table typically moves in the plane perpendicular to and along the axis 24 which extends through the cutting tool device 12. A machine spindle center 25, as illustrated in FIG. 1, extends along the cutting surface of the grinding tool 16. The positioning of the cutting tool device 12 preferably uses the center 25 as a reference. The work support table 22 is illustrated with a piece of workpiece 26 positioned on the top surface 28. The movement of the table is preferably controlled by a conventional computer system (not shown) which also controls the grinding head 14 and positioning of the probe.

After the workpiece 26 has been roughly cut to shape by the cutting tool 16, illustrated herein as an abrasive wheel, the workpiece 26 is measured to determine what remaining material is to be cut. As explained hereinbefore, it is well known in the machining industry to use a number of techniques to accomplish this measurement. However, each of these techniques has a limitation which reduces the degree of obtainable accuracy. Although the inaccuracies of the prior art techniques could be limited, the high degree of accuracy achieved by the present invention was not readily obtainable on a repeatable basis.

The present invention is particularly directed to an automatic measuring system 10 which automatically mounts a measurement probe 15 onto the grinding head 14 when the machine operator desires to measure the amount of material cut or remaining to be cut from the workpiece 26. The measurement probe 15 can be selected from any conventional type. The measurement probe 15 is preferably secured to a stem 30 by any conventional means. Preferably, the probe 15 is connected having a high degree of freedom of movement with respect to the stem 30 in order that probe 15 can be positioned as required. The measurement probe 15 is preferably connected to the conventional computer system, not shown, which correlates the movement of the grinding head 14 with the shape of the workpiece 26 as determined by the readings of probe 15. The end 17, of the probe 15 contacts the workpiece being measured and generates a reading corresponding to movement of end 17. With this information, the cutting tool 16 can be positioned to further cut the workpiece 26, as required.

A certified gauge block 31 is affixed to the surface 28 of the table 22. The gauge block 31 is calibrated by size and serves as a reference for the exact determination of the position of the probe 15. The technique of positioning the probe 15 using the gauge block 31 is described herein.

Figure 2:
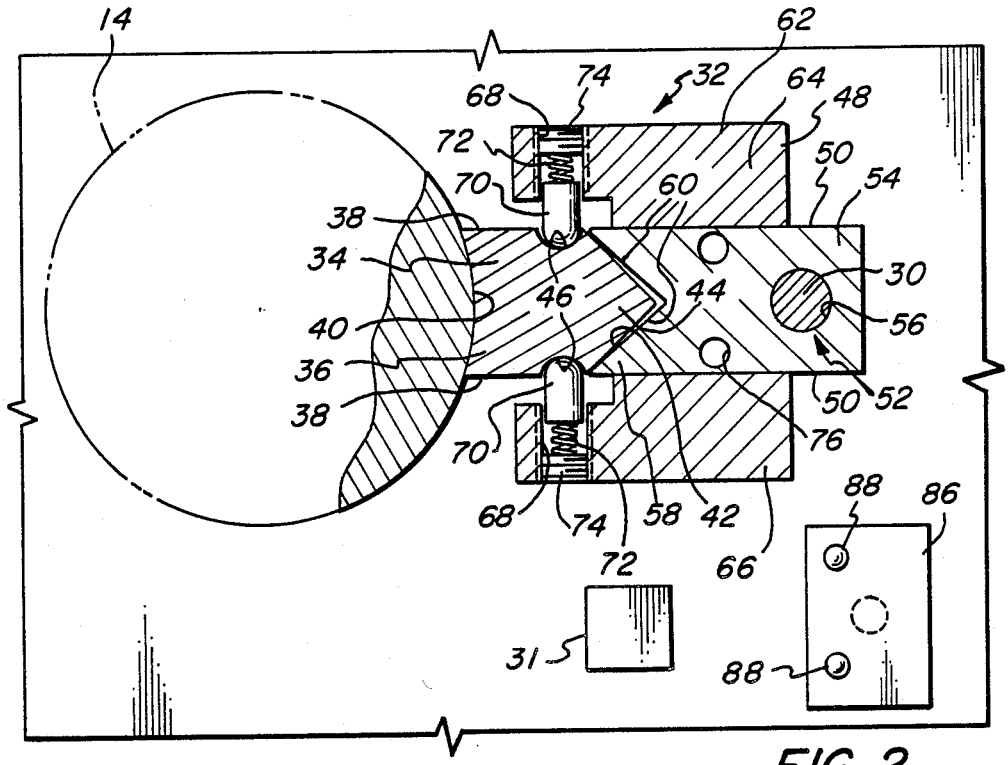
FIG. 2 is a view through 2—2 of FIG. 1, partially in cross-section.

Referring to both FIGS. 1 and 2, there is illustrated a coupling mechanism 32 which enables the probe 15 to be securely affixed to the tool holder 14. The coupling mechanism 32 includes a second coupling element 34 affixed to the tool holder 14. Preferably, the coupling element 34 is joined to the tool holder 14 by conventional means such as, for example, a weld, a clamp, one or more screws, or an adhesive. The coupling element 34 is affixed so that its position does not move relative to the tool holder 14.

As illustrated in FIG. 2, the second coupling element 34 comprises a projecting member 36 having walls 38 preferably formed into a substantially rectangular cross-section and affixed at one end 40 to the tool holder 14. The projecting member 36 also has a V-shaped surface configuration 42 at a second end 44 which intersects the walls 38 forming the rectangular cross-section. A plurality of indentations 46 are formed in the walls 38 adjacent the V-shaped surface configuration 42. Although two indentations 46 are illustrated, it is within the terms of the present invention to use any number of indentations as desired.

The coupling mechanism 32 also includes a first coupling element 48. The coupling element 48 comprises walls 50. The coupling 48 has a means 52 at a first end 54 for attaching the measurement probe 15. The device 52 for attaching the measurement probe can include a through hole 56 extending through coupling element 48. The through hole 56 is sized to receive the stem 30 which in turn is attached to the probe 15. The stem 30 can be securely affixed in the through hole 56 by any desired means such as for example a set screw (not shown). The second end 58 of the coupling element 48 includes a V-shaped recess 60. The recess 60 is shaped to securely mate with the V-shaped surface configuration 42 projecting from the first coupling element 34.

The coupling element 48 further includes a plunger support element 62 having at least two opposing arms 64 and 66 which project beyond the second end 58. Each of the arms 64 and 66 includes a through hole 68 sized to receive plungers 70. Each of the plungers 70 is biased by a spring 72 towards the opposing arm 64 or 66. The bias of the springs 72 can be varied by adjustment of the screws 74 positioned within the through holes 68. The coupling element 48 also includes one or more through holes 76 for securing the probe on a probe stand 78 as described hereinafter.

The probe stand 78 comprises a column member 80 which is preferably affixed at one end 82 to the work support table 22 by any desired means such as for example welding. However, it is also within the terms of the present invention to position the probe stand in any desired location. The other end 84 of the column 80 includes a support platform 86 having a plurality of upstanding lugs 88. Lugs 88 are positioned to cooperate with the through holes 76 in the second coupling element 48. Referring to FIGURE 2, there is illustrated a top view of the support platform 86 upon which two upstanding lugs 88 are illustrated as being spaced from each other essentially the same distance as between the two through holes 76.

To more fully understand the present invention, an illustration of the method by which the automatic measuring system 10 is employed follows. Referring to FIG. 1, the probe 15 is connected through the coupling mechanism 32 to the grinding head 14. The grinding head 14 can be moved using a computer aided device so that the end 17 of measurement probe 15 first contacts and measures gauge block 31. Then, the computer can correlate the machine movement and the deflection of probe 15. Next, the probe is moved by the computer to contact the workpiece 26 and establish the exact dimensions of the machined workpiece. An important aspect of the present invention relates to the fact that this measurement can be accomplished while the cutting tool 16 remains affixed to the cutting tool holder 14. After the dimensions of the workpiece 26 have been determined, the cutting tool device 12 can be controlled by the computer to precisely machine the workpiece with cutting tool 16 to the desired dimensions. Then, the tool holder 14 can be moved to align the through holes 76 on the end 54 of the coupling element 48 with the upstanding lugs 88 on the support platform 86. The coupling element 48 can then be lowered onto the upstanding lugs 88 to conveniently store the measurement probe until it is needed again. The movement of the tool holder 14 away from the seated coupling component 48 separates the coupling components 34 and 48.

When the probe is again required to measure workpiece 26, the process is reversed and the tool holder 14 lifts the coupling component 34 from platform 86 and aligns it so that the V-shaped recess 60 mates with the V-shaped surface 42. When the mating surfaces are firmly in place, the plungers 70 are biased into the indentations 46 on the coupling element 34. The combination of the V-shaped surfaces mating with one another and the plungers being biased into the indentations locks the probe into substantially the same position every time so that an extremely accurate measurement can be obtained. If a still more accurate measurement is required, the probe is calibrated using the gauge block 31 as described hereinbefore. The head 14 can now be raised to lift the coupling element 48 from the upstanding lugs 88 and the probe 15 can measure the gauge block 31 and/or the workpiece 26 as required.

In order to insure that the V-shaped surface 42 firmly and securely mates with the V-shaped recess 60, the coupling mechanism 32 can be vibrated by any means such as reciprocating the tool holder 14.

Although the positioning of the coupling has been described using the grinding head 14 alone, it is also within the terms of the present invention to connect and disconnect the coupling through positioning of the support table 22 alone in combination with the tool head 14.

Another embodiment of the present invention incorporates a conventional robotic device 90 which can include a robotic arm 92 for transporting the measurement probe 18 to and from the tool holder 14. The robotic device 90 is preferably connected to the computer control which operates the cutting tool device 12, the measurement probe 15 and the work support table 22. The specific robotic device 90 does not form a key aspect of the present invention and any conventional device may be employed. Preferably, the robotic arm 92 includes a gripping mechanism 94 at one end 96 which is capable of gripping the end 54 of the second coupling 48.

In operation, the robotic arm 92 can grasp the end 54 of the coupling element 48, when connected to element 34 as shown in FIG. 1, and pull it apart from the coupling element 34. The robotic arm can then position the coupling element 48 so that the through holes 76 line up with the upstanding lugs 88 on the support platform 86. The coupling element 48 can then be lowered onto the upstanding lugs 88 to conveniently store the measurement probe until it is needed again. When the probe is again needed to measure a workpiece 26, the process is reversed and the robotic arm 92 lifts the coupling component 48 from the upstanding lugs 88 and couples it to coupling 34 as previously described.

Figure 3:
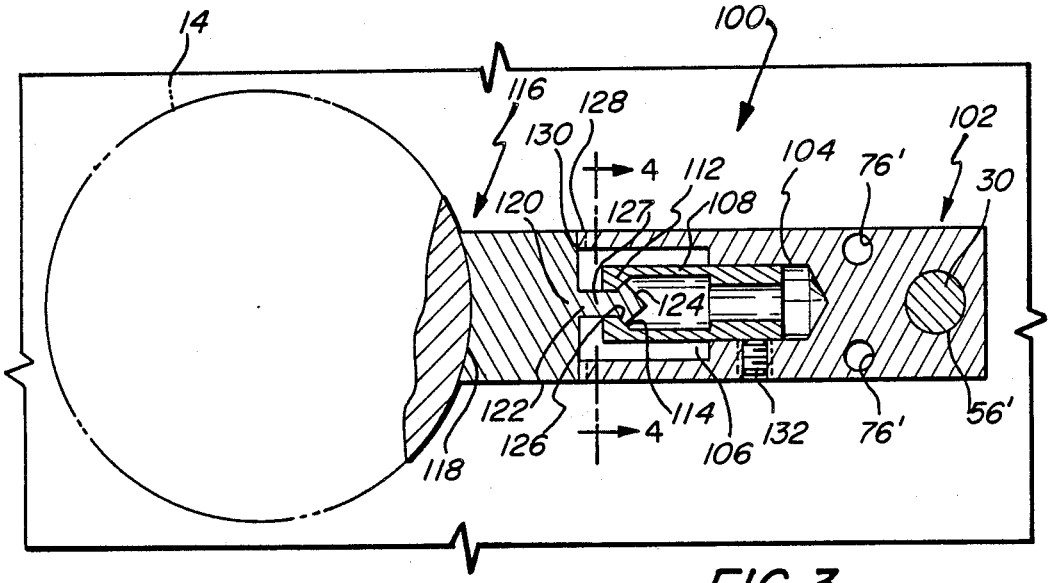
FIG. 3 is a schematic view, partially in cross-section, of an alternative coupling component.
Figure 4:
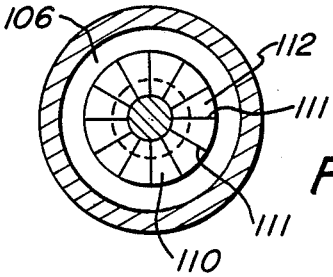
FIG. 4 is a view through 4—4 of FIG. 3.
Figure 5:
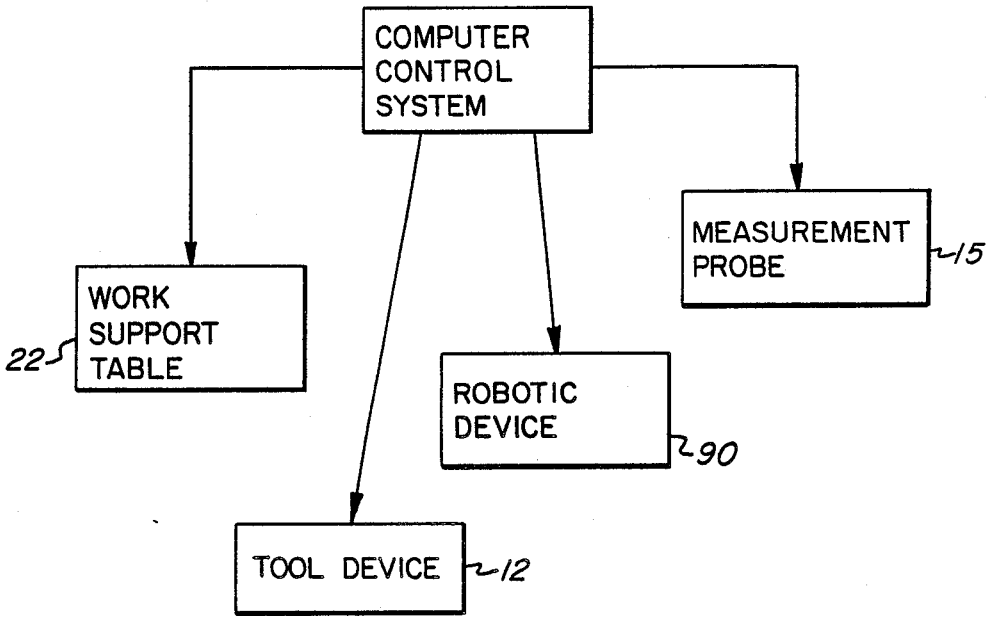

A second embodiment of the present invention is directed to a coupling component 100 as illustrated in FIG. 3. The coupling component 100 includes a first coupling element or component 102 having a first bore 104 and a second bore 106. A substantially cylindrical spring clamp 108 is disposed within bores 104 and 106. The spring clamp 108 includes a plurality of fingers 110 which are biased inwards towards each other. The end of each of the fingers 110 has two sidewalls 111 which are in contact with the sidewalls 111 of adjacent fingers. When the fingers 110 are biased towards each other and in contact as shown in FIG. 4, a substantially solid, inclined wall 114 is formed. Wall 114 securely engages the second coupling component 116 as described herein. The first coupling component 102 also includes a through hole 56' to receive the stem 30 which is affixed to the probe 15 as described hereinbefore. Primed numerals represent components which are substantially the same as those represented by the same unprimed numerals. In addition, through holes 76' are also provided to mate with the upstanding lugs 88 on the probe stand 78.

A second coupling component 116 has a substantially circular cross-section and includes a first end 118 which is securely affixed to the tool holder 14 by any desired means. A second end 120 of the coupling component 116 includes a protruding finger 122 having a conically shaped end surface 124 wherein the largest diameter is greater than the diameter of the finger 122.

A frustrum shaped surface 126 connects the surface 124 to the smaller diameter projecting element 127 of protruding finger 122. To effect the coupling, the first coupling component 102 is pressed against the second coupling component 116 so that the conical end surface 124 contacts and spreads the ends of the plurality of biased fingers 108. As the coupling element 102 continues to move towards the coupling element 116, the fingers 112 spring back so that the inclined wall 114 presses against the surface 126 formed on the protruding finger 122 and securely couples the components 102 and 116. The position of the plurality of fingers 108 is such that the end surface 128 of the first coupling component 102 is securely mated against the end surface 130 of the second coupling component 116. The end surfaces 128 and 130 are face gears which mate with each other to secure coupling components 102 and 116 to each other. The plurality of fingers 108 can be positioned within the bore 104 to adjust the fit and locked into place by any means such as set screw 132.

While the present invention has been described in terms of a V-shaped coupling and a face gear coupling, it is within the terms of the invention to incorporate other coupling systems including a cam lever clamp, a magnetic clamp, a hydraulic clamp or a pneumatic clamp.

The patents set forth in this application are intended to be incorporated in their entireties by reference herein.

It is apparent that there has been provided an automatic measuring system and the method of using the system which fully satisfies the objects, means, and advantages set forth hereinabove. While the invention has been described in combination with the specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An automatic measuring system adapted to measure a workpiece being machined with as cutting tool, comprising:

a tool holder containing the cutting tool;

a measurement probe;

means for supporting the workpiece; and control means operatively connected into said tool holder and said measurement probe; said control means comprising:

means for mounting and dismounting said measurement probe to and from said tool holder while the cutting tool remains affixed to said holder; and means for moving the measurement probe to contact said workpiece whereby the dimensions of the workpiece can be established.

2. The automatic measuring system of claim 1 wherein said means for mounting and dismounting includes a coupling mechanism, said coupling mechanism, comprising:

a first coupling component immovably affixed to said measurement probe;

a second coupling component affixed to said tool holder; and means for joining said first and second coupling components together in a mating relationship when the measurement probe is mounted to said tool holder whereby the first and second coupling components are securely affixed to each other.

3. The automatic measurement system of claim 2 including the means for supporting the workpiece comprising:

a work support table having said tool holder affixed thereto; and a measurement probe support platform affixed to said work support table to hold said measurement probe.

4. The automatic measurement system of claim 2 further including robotic arm means for transporting said measurement probe to and from said tool holder.

5. The automatic measurement system of claim 2 wherein:

said control means is further operatively connected to said work support table; and means for mounting and dismounting comprises means for moving said tool holder with respect to said work support table.

6. The automatic measurement system of claim 5 wherein said means for moving said tool holder with respect to said table includes means for positioning said measurement probe with respect to said work support table.

7. The automatic measurement system of claim 6 wherein said second coupling component comprises a projecting member being affixed at a first end to said tool holder;

said projecting member further having a V-shaped surface configuration at a second end; and a plurality of indentations in said projecting member.

8. The automatic measurement system of claim 7 wherein said first coupling component comprises means for attaching the measurement probe on a first end and a V-shaped recess in a second end, said V-shaped recess being shaped to securely mate with the V-shaped surface configuration projecting from said second coupling component; and a plunger support element comprising at least two opposing arms attached to said first component and projecting beyond said second end, each of said arms having a plunger biased towards the opposing arm and adapted to engage one of said indentations in the projecting member.

9. The automatic measurement system of claim 6 further comprising said first coupling component being substantially cylindrical and having a first bore extending therethrough;

a spring clamp including a plurality of fingers biased inwards towards each other, said clamp being disposed in said first bore;

said first coupling component being attached at a first end to said probe; and said first coupling component having a face gear in the end surface of the second end of the probe.

10. The automatic measurement system of claim 9 wherein said second coupling component has a first end secured to said tool holder and a protruding finger extending from the second end thereof;

said second end having an end surface with a face gear; and said protruding finger being secured to said plurality of fingers on said first component to securely affix the first and second coupling components whereby the face gears on the end surfaces of the first and second coupling components are coupled to each other.

11. The automatic measurement system of claim 6 further including means for vibrating said coupling mechanism to insure a secure mating relationship between said first and second coupling elements.

12. The automatic measurement system of claim 11 wherein said vibrating means comprises means to move said tool head with a reciprocating movement.

13. The method of automatically measuring a workpiece being machined with a cutting tool, comprising the steps of:

providing a tool holder containing the cutting tool;

providing a measurement probe;

supporting the workpiece;

providing a control device operatively connected with said tool holder and said measurement probe;

operating said control device including the steps of:

mounting said measurement probe to and from said tool holder containing the cutting tool; and moving the measurement probe to contact said workpiece whereby the dimensions of the workpiece can be established.

14. The method of claim 13 further comprising the step of dismounting said measurement probe from said tool holder.

15. The method of claim 14, wherein the step of supporting the workpiece comprises the steps of:

providing a work support table for supporting a workpiece having a gauge block affixed thereto;

measuring said gauge block with said measurement probe by moving said tool holder with respect to said work support table; and establishing the dimensions of the workpiece with said measurement probe by moving said tool holder with the respect to said work support table.

16. The method of claim 14 including the step of storing said measurement probe on said work support table when the measurement probe is not mounted on said tool holder.

17. The method of claim 13 including the steps of:

providing a coupling mechanism to mount said measurement probe to said tool holder, said coupling mechanism including a second coupling component immovably affixed to said tool holder and a first coupling component affixed to said measurement probe; and automatically moving said second coupling component into mating relationship with said first coupling component whereby the first and second coupling components are securely affixed to one another.

18. The method of claim 17 including the step of vibrating said coupling mechanism to insure a secure mating relationship.

19. The automatic measuring system adapted for use with a cutting tool device, comprising:

a tool holder for mounting a cutting tool;

a measurement probe;

a work support table having said tool holder affixed thereto;

a measurement probe support platform affixed to said work support table to hold said measurement probe; and means for automatically mounting and dismounting said measurement probe to and from said tool holder, said means for mounting and dismounting includes a coupling mechanism, said coupling mechanism, comprising:

a first coupling component affixed to said measurement probe;

a second coupling component affixed to said tool holder; and means for joining said first and second coupling components together in a mating relationship whereby the first and second coupling components are securely affixed to each other.

20. The method of automatically measuring a workpiece, comprising the steps of:

providing a tool holder;

providing a measurement probe;

automatically mounting said measurement probe on said tool holder.

automatically dismounting said measurement probe from said tool holder;

providing a work support table having said tool holder affixed thereto, said work support table having a gauge block affixed thereto, said work support table being adapted to support a workpiece;

providing a cutting tool in said tool holder; and measuring said gauge block with said measurement probe by moving said tool holder with respect to said work support table; and measuring the workpiece with said measurement probe by moving said tool holder with respect to said work support table.

21. The method of automatically measuring a workpiece, comprising the steps of:

providing a tool holder;

providing a measurement probe;

automatically mounting said measurement probe on said tool holder;

providing a coupling mechanism to mount said measurement probe to said tool holder, said coupling mechanism including a second coupling component affixed to said tool holder and a first coupling component affixed to said measurement probe;

automatically moving said second coupling component into mating relationship with said first coupling component whereby the first and second coupling components are securely affixed to one another; and vibrating said coupling mechanism to insure a secure mating relationship.

* * * * *

UNITED STATES PATENT AND TRADEMARK OFFICE

CERTIFICATE OF CORRECTION

PATENT NO. : 4,890,421

DATED : January 2, 1990

INVENTOR(S) : Wayne R. Moore, Jr. and Kevin S. Barney

It is certified that error appears in the above-identified patent and that said Letters Patent is hereby corrected as shown below:

In Claim 1, line 32, delete "as" and replace with -- a --.

In Claim 1, line 42, insert -- tool -- before "holder".

In Claim 15, line 24, delete "the" before "respect".

Signed and Sealed this

Thirtieth Day of October, 1990

*Attest:*

*Attesting Officer*

HARRY F. MANBECK, JR.

*Commissioner of Patents and Trademarks*